US009067720B2

(12) United States Patent
Howell et al.

(10) Patent No.: US 9,067,720 B2
(45) Date of Patent: Jun. 30, 2015

(54) CONTACT LENS DISPENSING APPARATUS

(75) Inventors: Larry L. Howell, Orem, UT (US); Spencer P. Magleby, Provo, UT (US); Holly C. Greenberg, Davie, FL (US); Samuel E. Wilding, Springville, UT (US)

(73) Assignee: Brigham Young University, Provo, UT (US)

( * ) Notice: Subject to any disclaimer, the term of this patent is extended or adjusted under 35 U.S.C. 154(b) by 198 days.

(21) Appl. No.: 13/572,616

(22) Filed: Aug. 11, 2012

(65) Prior Publication Data

US 2014/0027465 A1 Jan. 30, 2014

Related U.S. Application Data

(60) Provisional application No. 61/677,194, filed on Jul. 30, 2012.

(51) Int. Cl.

| | |
|---|---|
| ***A45C 11/04*** | (2006.01) |
| ***B65D 83/00*** | (2006.01) |
| ***B65D 75/32*** | (2006.01) |

(52) U.S. Cl.

CPC ..... *B65D 83/00* (2013.01); *B65D 75/326* (2013.01); *B65D 2575/3218* (2013.01); *B65D 2575/3245* (2013.01); *B65D 2585/545* (2013.01)

(58) Field of Classification Search

CPC ..... A45C 11/005; A61L 12/086; B65D 2585/545; B65D 75/366; B65D 2575/367

USPC ..... 206/5.1, 249, 250, 817, 751–752, 754, 206/767; 220/212; 134/901

See application file for complete search history.

(56) References Cited

U.S. PATENT DOCUMENTS

| | | | | |
|---|---|---|---|---|
| 1,153,963 | A * | 9/1915 | Sengstock | 206/804 |
| 1,732,214 | A * | 10/1929 | Amez-Droz | 206/754 |
| 7,540,376 | B2 * | 6/2009 | Mahieu et al. | 206/5.1 |
| 8,474,619 | B1 * | 7/2013 | Chrisman | 206/449 |
| 2008/0047848 | A1 * | 2/2008 | Tokarski et al. | 206/5.1 |

* cited by examiner

*Primary Examiner* — Mickey Yu
*Assistant Examiner* — Chun Cheung

(57) ABSTRACT

In one general aspect, an apparatus can include a container for storing a contact lens where the container comprises a sealed removable lid configured to retain liquid within the container previous to unsealing and opening the sealed removable lid. The apparatus can also include a contact lens cradle configured to cradle a contact lens placed thereon and a lifting mechanism connected to the contact lens cradle and the sealed removable lid that lifts the contact lens cradle from a storage position within the container to a dispensing position above the container in response to opening the sealed removable lid of the container.

20 Claims, 3 Drawing Sheets

CONTACT LENS DISPENSING APPARATUS

RELATED APPLICATIONS

This application claims priority to U.S. Provisional Application 61/677,194 entitled "A Novel Lamina Emergent Mechanism" and filed on 30 Jul. 2012 for Larry L. Howell, Spencer P. Magleby, Holly C. Greenberg and Samuel E. Wilding. The foregoing application is incorporated herein by reference in its entirety.

BACKGROUND OF THE INVENTION

1. Field of the Invention

The invention relates to contact lens storage and dispensing devices.

2. Description of the Related Art

Currently available contact lens dispensing devices typically require a user to touch the contact lens multiple times previous to placing the contact lens upon the eye. Each point and instance of contact with the user may transfer bacteria or germs from the epidermis of the user to the contact lens and thereby increase the risk of infection to the eye. What is needed is a low-cost device to dispense a contact lens that reduces the number of times that a user is required to touch a contact lens previous to placing the contact lens upon the eye.

SUMMARY OF THE INVENTION

The present invention has been developed in response to the present state of the art, and in particular, in response to the problems and needs in the art that have not yet been fully solved by currently available contact lens dispensing devices and methods. Accordingly, the present invention has been developed to provide an apparatus for dispensing a contact lens that overcomes many of the shortcomings in the art.

As detailed below, a contact lens dispensing apparatus may include a container for storing a contact lens with a lid that removably seals the container. The apparatus may also include a cradle that cradles a contact lens and a lifting mechanism connected to the cradle and the lid. The lifting mechanism may lift the cradle from a storage position within the container to a dispensing position above the container in response to opening the lid of the container.

In one embodiment, the container is a bowl with a foil lid. The bowl and foil lid may collectively form a blister pack with a contact lens enclosed therein. The lid may protect the contact lens from foreign matter including bacteria while the contact lens is stored in the container.

The lifting mechanism may include a number of links and hinge points that facilitate translational movement of the cradle relative to the container. The hinge points may comprise living hinges made of the same material as the links connected thereto. The lifting mechanism and the cradle may collectively comprise a laminar emergent mechanism that is integrally formed from a planar sheet of material such as a sheet of plastic material.

The cradle may cradle a contact lens placed thereon and include a void that enables a user to slide the contact lens off of the cradle by contacting the lens through the void with an index finger, or the like, on the non-eye side of the lens when the cradle is in the dispensing position.

The present invention provides a variety of advantages. It should be noted that references to features, advantages, or similar language within this specification does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

The aforementioned features and advantages of the present invention will become more fully apparent from the following description and appended claims, or may be learned by the practice of the invention as set forth hereinafter.

BRIEF DESCRIPTION OF THE DRAWINGS

To enable the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Figure 1A:
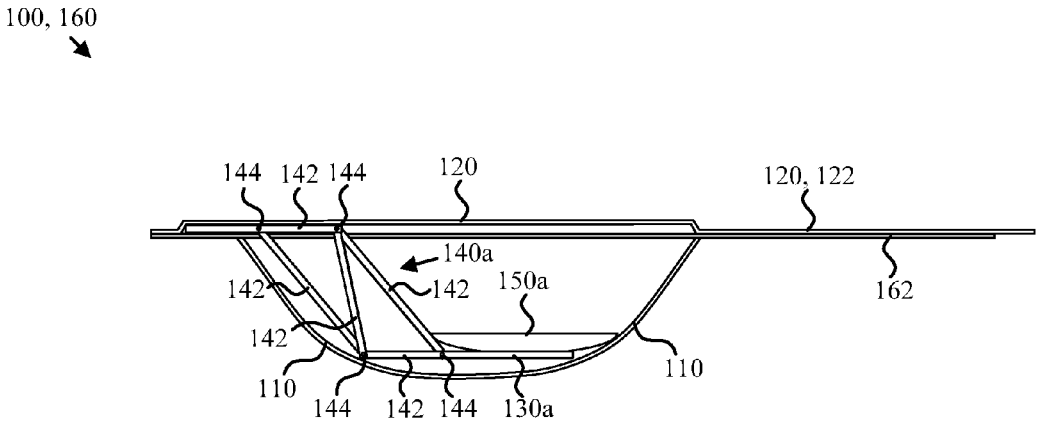
FIGS. 1*a* and 1*b* are cross-sectional side view illustrations depicting one embodiment of a contact lens dispensing apparatus of the present invention.
Figure 1B:
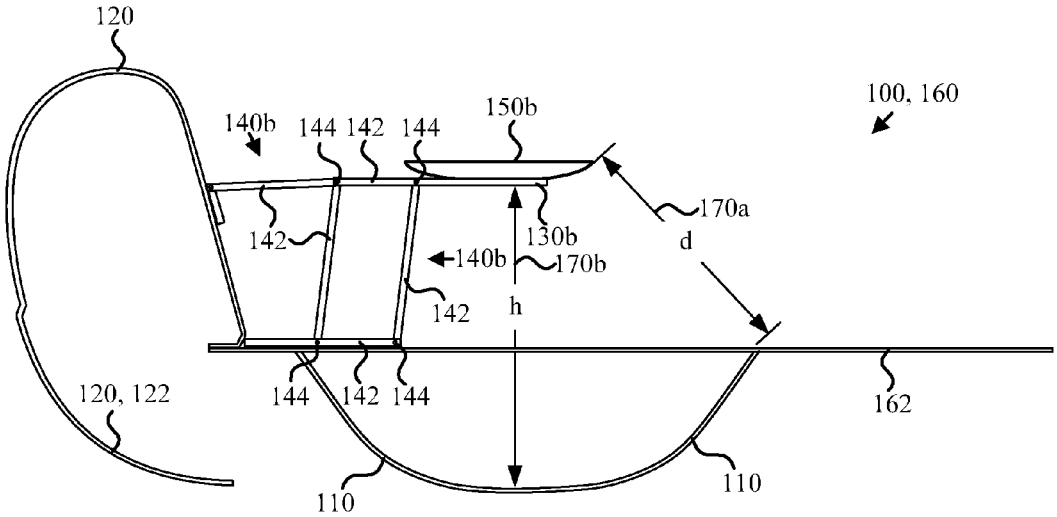

FIGS. 1*a* and 1*b* are cross-sectional side view illustrations depicting one embodiment of a contact lens dispensing apparatus 100 of the present invention. As depicted, the apparatus 100 includes a container 110 with a lid 120, a cradle 130, a lifting mechanism 140, and a contact lens 150. FIG. 1*a* shows the lifting mechanism 140 in a storage position 140*a* while FIG. 1*b* shows the lifting mechanism in a dispensing position 140*b*.

In the depicted embodiment, the container 110 is a bowl with a foil lid 120 that covers the bowl. The depicted bowl 110 and foil lid 120 collectively comprise a blister pack 160. The lid 120 may removably seal the container 110 and protect the contact lens from foreign matter including bacteria. In the depicted embodiment, the blister pack 160 and the foil lid 120 comprise peeling tabs 122 and 162 that facilitate removal of the lid 120.

The cradle 130 may cradle a contact lens placed thereon and enable a user to slide the contact lens off of the cradle with an index finger or the like (not shown) placed below the cradle 130 when the lifting mechanism 140 is in the dispensing position 140*b*.

As shown in FIGS. 1*a* and 1*b*, the lifting mechanism 140 may include a number of links 142 and hinge points 144 that facilitate translational movement of the cradle relative to the container 110. Furthermore, the lifting mechanism may be connected to the cradle and the lid in a manner that causes the lifting mechanism 140 to lift the cradle 130 from a storage position 130*a* within the container 110 to a dispensing position 130*b* above the container in response to opening the lid 120 of the container 110. The lifting mechanism may be configured to provide a minimal clearance 170*a* and a vertical clearance 170*b* that is sufficient for most individuals to insert an index finger between the container 110 and the cradle 130 and/or the contact lens 150. In one embodiment, the minimal clearance 170*a* and the vertical clearance 170*b* are greater than 12 mm.

In certain embodiments, the hinge points 144 comprise living hinges made of the same material as the links 142 connected thereto. In some embodiments, the links 142 have lengths that correspond to a dyad four-bar or a parallel four-bar. The lifting mechanism 140 and the cradle 130 may collectively comprise a laminar emergent mechanism that is integrally formed from a planar sheet of material such as a sheet of plastic material.

Figure 2:
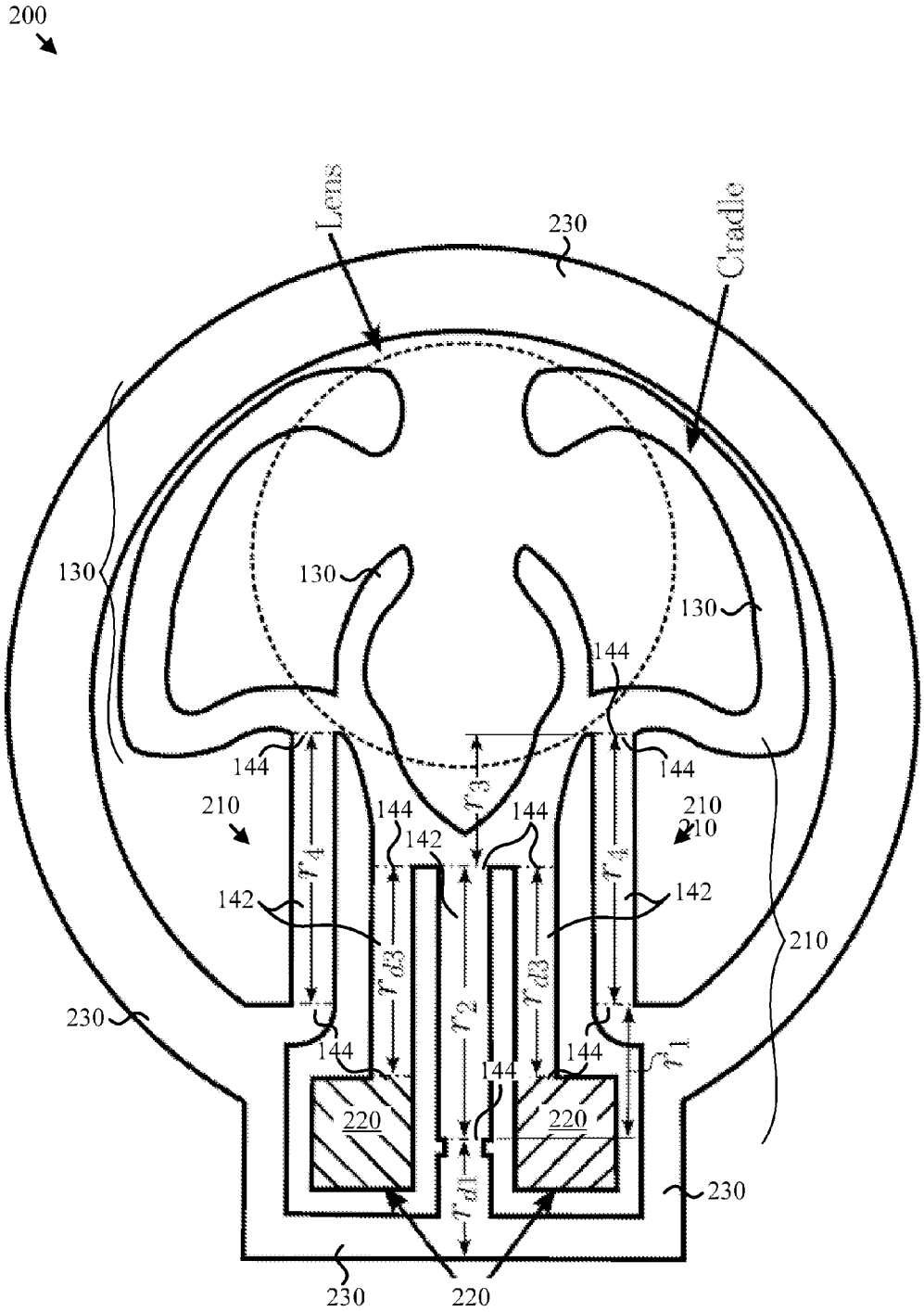
FIG. 2 is a top view illustration of a laminar mechanism of the present invention.

FIG. 2 is a top view illustration of one specific embodiment of a laminar mechanism 200 of the present invention. As depicted, the laminar mechanism 200 includes a cradle 130, a lifting mechanism 210, one or more attachment pads 220, and a rim 230. The laminar mechanism is an emergent mechanism that may be leveraged within the contact lens dispensing apparatus 100.

The cradle 130, the lifting mechanism 210, the attachment pads 220 and the rim 230 may be integrally formed from a planar sheet of material such as a plastic. The cradle 130 may include a void 132 that enables a user to make contact with the non-eye (bottom) side of a lens placed on the cradle 130. As depicted, the lifting mechanism 210 includes a number of links 142 with hinge points 144 that enable the mechanism 210 to move in response to movement of the attachment pads 220 (e.g. in an out of the page) relative to the rim 230. The rim 230 may be attached to a container such as the container 110. Movement of the attachment pads 220 can also cause the cradle 130 to move to a storage position or a dispensing position similar to what is shown in FIG. 1.

In the depicted embodiment, the hinge points 144 comprise living hinges made of the same material as the links 142 connected thereto. In some embodiments, the links have lengths r that correspond to a dyad four-bar or a parallel four-bar.

Figure 3:
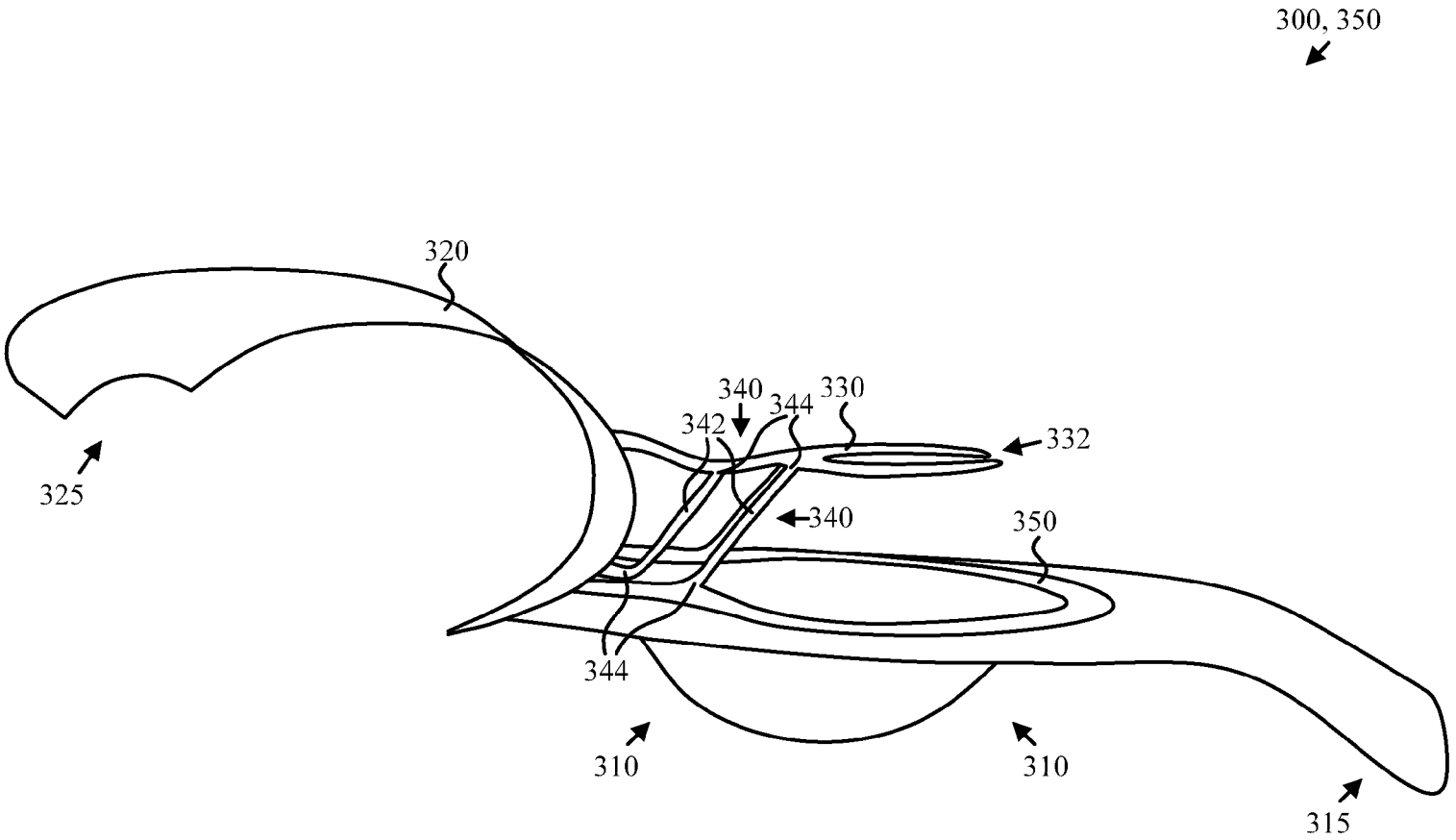
FIG. 3 is a perspective view illustration depicting one embodiment of a contact lens dispensing apparatus of the present invention.

FIG. 3 is a perspective view illustration depicting one specific embodiment of a contact lens dispensing apparatus 300 of the present invention. As depicted, the apparatus 300 includes a container 310 with a peeling tab 315, a lid 320 with a peeling recess 325, a cradle 330 with a void 332, a lifting mechanism 340 and a rim 350. The apparatus 300 is shown in a dispensed state where a user has peeled away the lid from the container 310 and moved the cradle 330 to a dispensing position via the lifting mechanism 340.

In the depicted embodiment, the container 310 is a bowl with a lid 320 that covers the bowl when the apparatus is in a storage state (not shown). The lid 320 may comprise a foil. The container 310 and the lid 320 collectively comprise a blister pack 350 shown in an opened state. While the apparatus 300 is in the storage state the lid 320 may removably seal the container 310 and protect the contact lens from foreign matter including bacteria. In the depicted embodiment, the peeling tab 315 and peeling recess 325 facilitate peeling the lid 320 away from the container 310.

As depicted, the lifting mechanism 340 may include a number of links 342 and hinge points 344 that facilitate translational movement of the cradle 330 relative to the container 310. In the depicted embodiment, the hinge points 344 comprise living hinges made of the same material as the links 342 connected thereto. The links may have lengths that correspond to a dyad four-bar or a parallel four-bar.

The cradle 330 and the lifting mechanism 340 may be encompassed by a rim 350. The rim 350 may be attached to the container 310 and provide a base for the lifting mechanism 340. The depicted rim 350, lifting mechanism 340 and cradle 330 collectively comprise a laminar emergent mechanism that is integrally formed from a planar sheet of material such as a sheet of plastic material.

In response to peeling the foil lid 320 away from the container 310, the lifting mechanism 340 may complete the translation movement of the cradle 330 to the shown dispensing position. Once the cradle is in the dispensing position a user may remove a contact lens for placement upon an eye by touching the non-eye side of a lens through the void 332 and sliding the lens off of the cradle 330.

The present invention provides a low-cost device to dispense a contact lens that reduces the number of times that a user is required to touch a contact lens previous to placing the contact lens upon the eye. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a container for storing a contact lens, the container comprising a sealed removable lid configured to retain liquid within the container previous to unsealing and opening the sealed removable lid;

a contact lens cradle configured to cradle a contact lens placed thereon;

a lifting mechanism connected to the contact lens cradle and the sealed removable lid that lifts the contact lens cradle from a storage position within the container to a dispensing position above the container in response to opening the sealed removable lid of the container; and wherein the lifting mechanism and the contact lens cradle are integrally formed from a planar sheet of material and the contact lens cradle comprises a void that enables a user to contact the contact lens with an upward facing index finger placed below the cradle and slide the contact lens off of the cradle when the cradle is in the dispensing position.

2. The apparatus of claim 1, wherein the lifting mechanism comprises a plurality of links and a plurality of hinge points.

3. The apparatus of claim 2, wherein the hinge points comprise living hinges.

4. The apparatus of claim 2, wherein the links have lengths that correspond to a dyad four-bar.

5. The apparatus of claim 2, wherein the links have lengths that correspond to a parallel four-bar.

6. The apparatus of claim 1, wherein the lifting mechanism and the contact lens cradle collectively comprise a laminar mechanism.

7. The apparatus of claim 1, wherein the planar sheet of material comprises a plastic material.

8. The apparatus of claim 1, wherein the container comprises a bowl.

9. The apparatus of claim 1, wherein the container and sealed removable lid collectively comprise a blister pack.

10. The apparatus of claim 1, wherein the lifting mechanism is configured to provide a translational motion path for the contact lens cradle between the storage position and the dispensing position.

11. The apparatus of claim 2, wherein a clearance between the container and the contact lens cradle in the dispensing position is greater than 12 mm.

12. The apparatus of claim 1, further comprising a rim formed from the planar sheet of material that is connected to the lifting mechanism and attached to the container.

13. An apparatus comprising:

means for storing a contact lens, the means for storing comprising a sealed removable lid;

means for cradling a contact lens placed thereon;

means for lifting connected to the means for cradling and the sealed removable lid, the means for lifting configured to lift the means for cradling from a storage position within the means for storing to a dispensing position above the means for storing in response to opening the sealed removable lid; and wherein the means for lifting and the means for cradling are integrally formed from a planar sheet of material and the means for cradling comprises a void that enables a user to contact the contact lens with an upward facing index finger placed below the means for cradling and slide the contact lens off the means for cradling when the means for cradling is in the dispensing position.

14. The apparatus of claim 13, wherein the means for lifting comprises a plurality of links and a plurality of hinge points.

15. The apparatus of claim 13, wherein the means for lifting and the means for cradling collectively comprise a laminar emergent mechanism.

16. The apparatus of claim 13, wherein the means for storing comprises a bowl.

17. The apparatus of claim 13, wherein the means for storing comprises a blister pack.

18. The apparatus of claim 13, wherein the means for lifting provides a translational motion path for the means for cradling between the storage position and the dispensing position.

19. The apparatus of claim 18, wherein a clearance between the means for storing and the means for cradling in the dispensing position is greater than 12 mm.

20. The apparatus of claim 13, further comprising means for attaching the means for lifting to the means for storing, wherein the means for attaching is integrally formed from the planar sheet of material.

* * * * *